US005450957A

United States Patent [19]

Erb

[11] Patent Number: 5,450,957

[45] Date of Patent: Sep. 19, 1995

[54] ARCHERY BOW CASE AND BLIND COMBINATION

[76] Inventor: Rodney J. Erb, 1306 S. New Wilke Unit 2D, Arlington Heights, Ill. 60005

[21] Appl. No.: 339,791

[22] Filed: Nov. 15, 1994

[51] Int. Cl.[6] ..... B65D 85/00

[52] U.S. Cl. ..... 206/315.11; 206/317

[58] Field of Search ..... 206/315.1, 315.11, 317, 206/579; 190/102; 383/902

[56] References Cited

U.S. PATENT DOCUMENTS

| | | | |
|---|---|---|---|
| 3,191,652 | 6/1965 | Benson et al. | 206/317 |
| 3,865,166 | 2/1975 | Pedro | 206/317 |
| 4,480,774 | 11/1984 | Smith et al. | 206/317 X |
| 4,726,141 | 2/1988 | McBride et al. | 206/315.11 X |
| 4,842,133 | 6/1989 | LaBarge et al. | 206/579 X |
| 5,327,669 | 7/1994 | Lannan et al. | 206/315.11 X |

*Primary Examiner*—Jacob K. Ackun

[57] ABSTRACT

An archery bow case and blind combination comprising a cover formed of a sheet of flexible material, the cover including an exterior surface, an interior surface, a periphery formed of a front edge, a rear edge, and a pair of opposed side edges, and a midline defined therethrough and extended from the front edge to the rear edge, the cover foldable along the midline to create two symmetrically opposed sides with a hollow interior defined therebetween sized for receiving a bow; a coupling mechanism coupled along the periphery of the cover for releasably securing the sides to each other and precluding access to the interior; a pair of rods secured along opposed side edges of the cover with each rod having an end projected outwardly from the rear edge of the cover for securement within a recipient object for holding the cover in an upstanding position for use as a blind; and a handle mechanism coupled to the exterior surface of the cover for allowing a user a firm grip.

8 Claims, 4 Drawing Sheets

ARCHERY BOW CASE AND BLIND COMBINATION

BACKGROUND OF THE INVENTION

1. Field of the Invention

The present invention relates to an archery bow case and blind combination and more particularly pertains to allowing an archer to transport a bow from one location to another and conceal himself from potential targets with an archery bow case and blind combination.

2. Description of the Prior Art

The use of bow transport devices is known in the prior art. More specifically, bow transport devices heretofore devised and utilized for the purpose of transporting a bow from one location to another are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 246,138 to Christensen et al. discloses a carrying case for an archer's bow or the like. U.S. Pat. No. Des. 291,503 to Hayes discloses a bow holster. U.S. Pat. No. Des. 343,057 to Dickenson discloses a bow case. U.S. Pat. No. 4,024,997 to Kolpin discloses a gun case including means for suspending the gun case from a support. U.S. Pat. No. 4,475,247 to Lee discloses a combination gun case and protective apparel.

While these devices fulfill their respective, particular objective and requirements, the aforementioned patents do not describe an archery bow case and blind combination that allows a bow to be transported from one location to another and also serves a blind when hunting.

In this respect, the archery bow case and blind combination according to the present invention substantially departs from the conventional concepts and designs of the prior art, and in doing so provides an apparatus primarily developed for the purpose of allowing an archer to transport a bow from one location to another and conceal himself from potential targets.

Therefore, it can be appreciated that there exists a continuing need for new and improved archery bow case and blind combination which can be used for allowing an archer to transport a bow from one location to another and conceal himself from potential targets. In this regard, the present invention substantially fulfills this need.

SUMMARY OF THE INVENTION

In the view of the foregoing disadvantages inherent in the known types of bow transport devices now present in the prior art, the present invention provides an improved archery bow case and blind combination. As such, the general purpose of the present invention, which will be described subsequently in greater detail, is to provide a new and improved archery bow case and blind combination and method which has all the advantages of the prior art and none of the disadvantages.

To attain this, the present invention essentially comprises, in combination, a cover. The cover is formed of a first sheet of camouflage-type cloth material. The cover includes an exterior surface, an interior surface, a generally rectangular rear portion, a generally trapezoidal front portion, a periphery enclosing the portions formed of a front edge, a rear edge, and a pair of opposed side edges, and a midline defined therethrough and extended from the midpoint of the front edge to the midpoint of the rear edge. The cover further includes a lining formed of a second sheet of cloth material extended across and secured to the interior surface. The sheets are foldable along the midline to conceal the lining and create two symmetrically opposed sides with a hollow interior defined therebetween sized for receiving a bow. A zipper is included and coupled along the front and side edges of the cover with the zipper having a closed orientation for securing the sides to each other and an open orientation for releasing the sides from each other. A first, a second, and a third rigid fiberglass rod are included with the first and second rod secured along opposed side edges of the cover and with the third rod secured along the midline of the cover. Each rod has an end projected outwardly from the rear edge of the cover and terminated at a point. The points of the rods are securable within a recipient object for holding the cover in an upstanding position for use as a blind. A coupling mechanism is included and formed of a strip of pile type fastener secured to the exterior surface of a side of the cover near the rear edge thereof and flap secured to the rear edge of the other side of the cover with a strip of complimentary pile type fastener coupled thereto. The strips are securable to each other in one mode. The strips are releasable from each other in another mode for allowing quick access to the interior when the zipper is in the closed orientation. A handle is included and coupled to the exterior surface of the cover at the midline for allowing a user a firm grip. Lastly, three rigid clamps are included. Each clamp has a body with a mouth, an adjustable bolt threadedly coupled to the body and extendable within the mouth, and a bore formed on the body opposite the mouth for receiving a point of a rod. The clamps are coupleable to a recipient object for allowing the cover to be used as a blind when the points of the rods are separately disposed within the bores.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery bow case and blind combination which has all the advantages of the prior art bow transport devices and none of the disadvantages.

It is another object of the present invention to provide a new and improved archery bow case and blind combination which may be easily and efficiently manufactured and marketed.

It is a further object of the present invention to provide a new and improved archery bow case and blind combination which is of durable and reliable construction.

An even further object of the present invention is to provide a new and improved archery bow case and blind combination which is susceptible of a low cost of manufacture with regard to both materials and labor, and which accordingly is then susceptible of low prices of sale to the consuming public, thereby making such an archery bow case and blind combination economically available to the buying public.

Still yet another object of the present invention is to provide a new and improved archery bow case and blind combination which provides in the apparatuses and methods of the prior art some of the advantages thereof, while simultaneously overcoming some of the disadvantages normally associated therewith.

Even still another object of the present invention is to provide a new and improved archery bow case and blind combination for allowing an archer to transport a bow from one location to another and conceal himself from potential targets.

Lastly, it is an object of the present invention to provide a new and improved archery bow case and blind combination comprising a cover formed of a sheet of flexible material, the cover including an exterior surface, an interior surface, a periphery formed of a front edge, a rear edge, and a pair of opposed side edges, and a midline defined therethrough and extended from the front edge to the rear edge, the cover foldable along the midline to create two symmetrically opposed sides with a hollow interior defined therebetween sized for receiving a bow; coupling means coupled along the periphery of the cover for releasably securing the sides to each other and precluding access to the interior; a pair of rods secured along opposed side edges of the cover with each rod having an end projected outwardly from the rear edge of the cover for securement within a recipient object for holding the cover in an upstanding position for use as a blind; and handle means coupled to the exterior surface of the cover for allowing a user a firm grip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
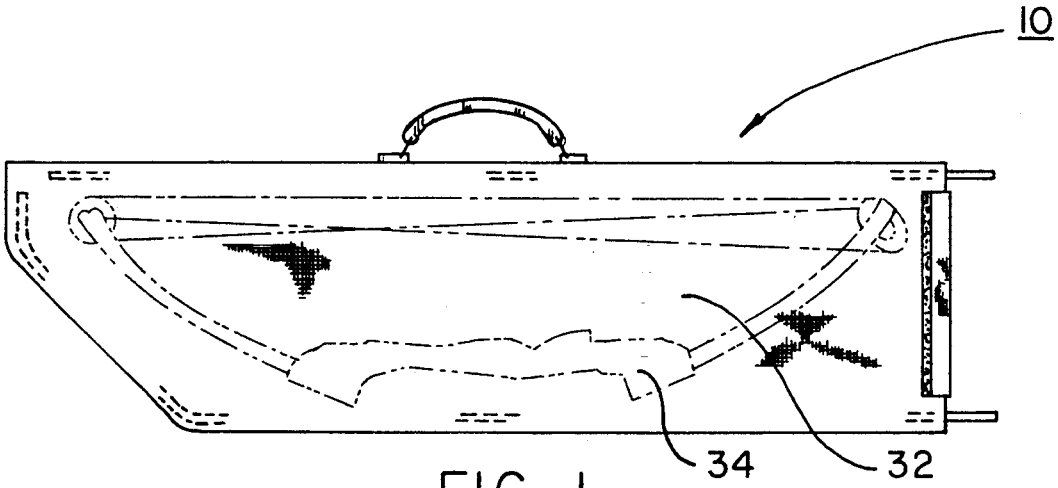
FIG. 1 is a plan view of the preferred embodiment constructed in accordance with the present invention placed in an configuration for use as a case for carrying a bow.
Figure 2:
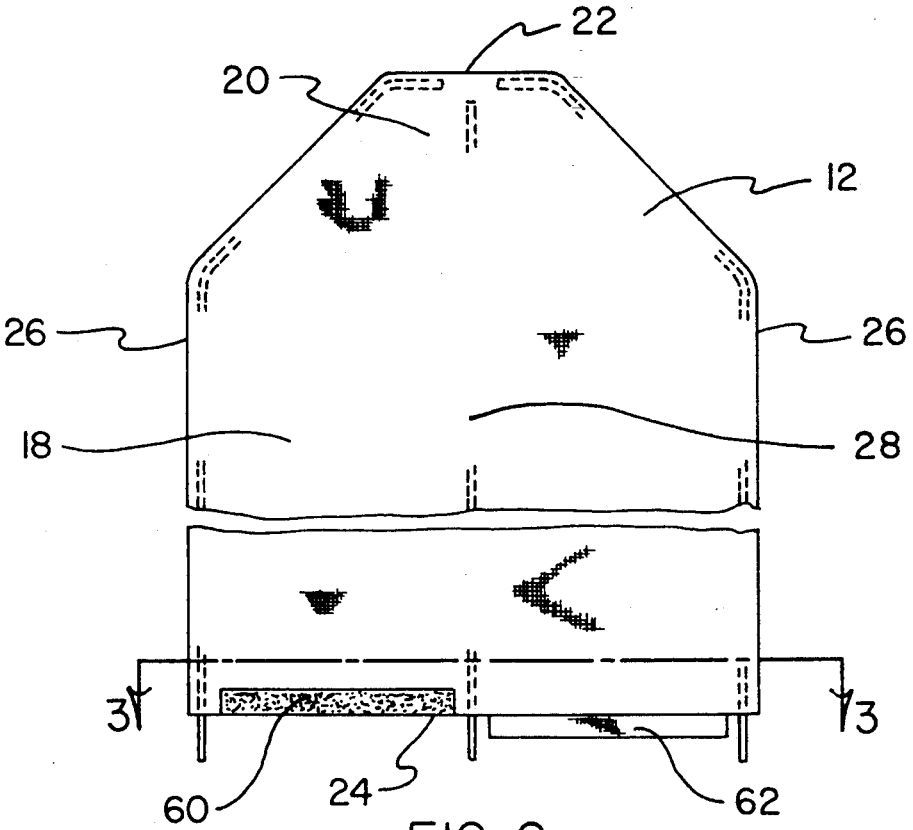
FIG. 2 is another plan view of the present invention placed in a configuration for use as a blind.
Figure 3:
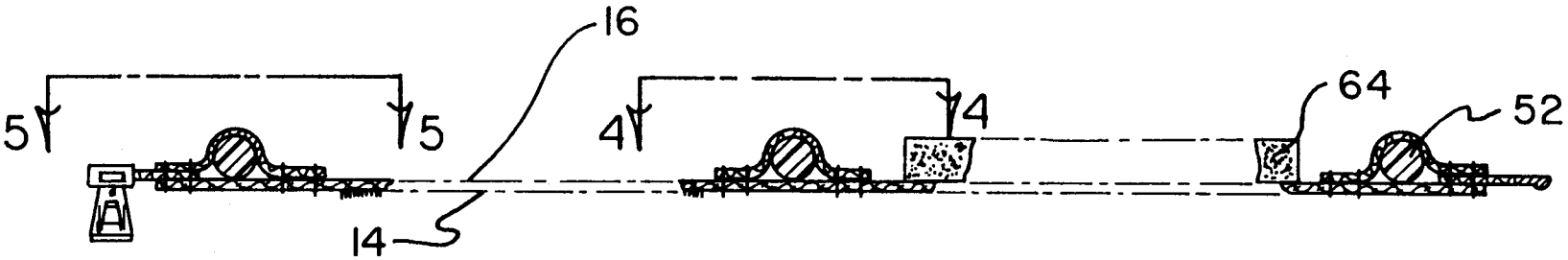
FIG. 3 is a cross-sectional view of the present invention taken along the lines 3—3 of FIG. 2.
Figure 5:
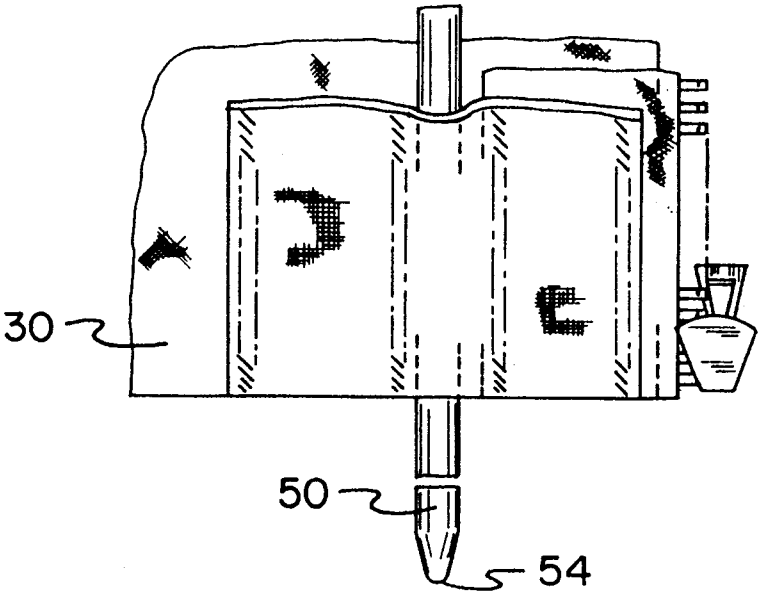
FIG. 5 is a enlarged view of the present invention taken along the line 5—5 of FIG. 5.
Figure 4:
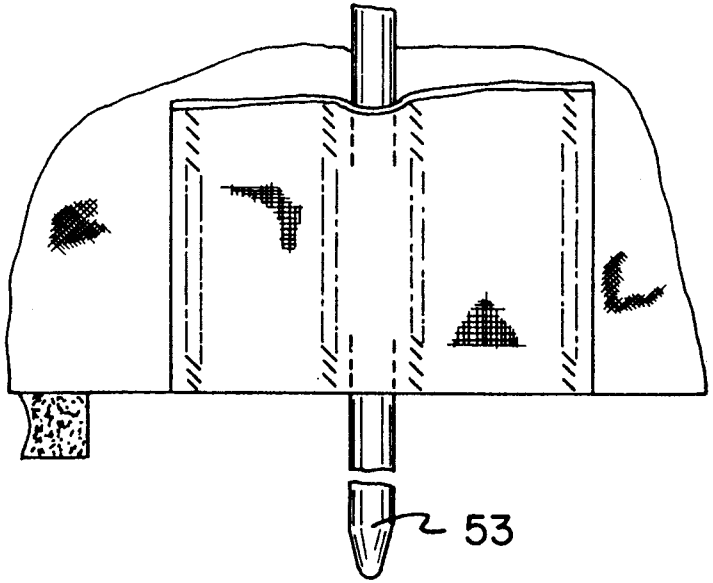
FIG. 4 is a enlarged view of the present invention taken along the line 4—4 of FIG. 3.
Figure 6:
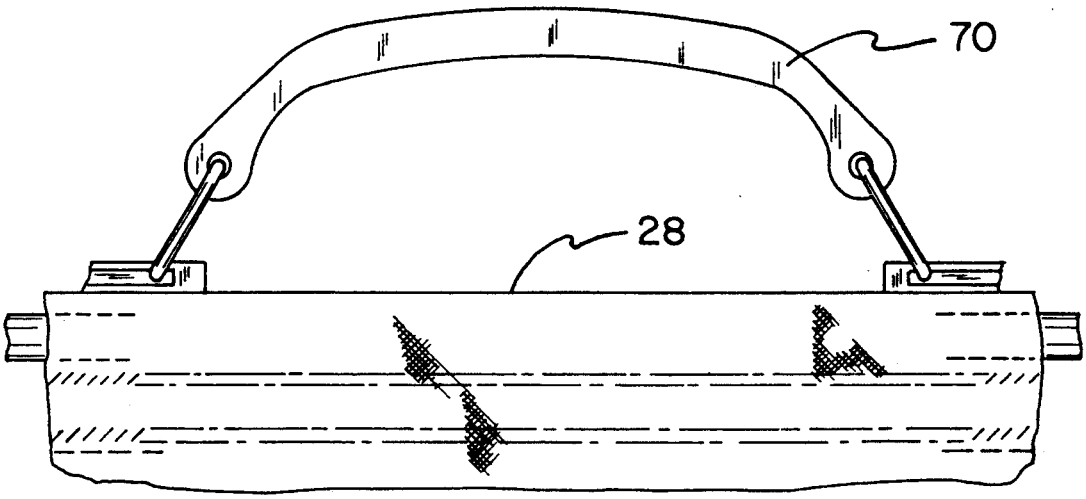
FIG. 6 is an enlarged view of the handle of the present invention.
Figure 7:
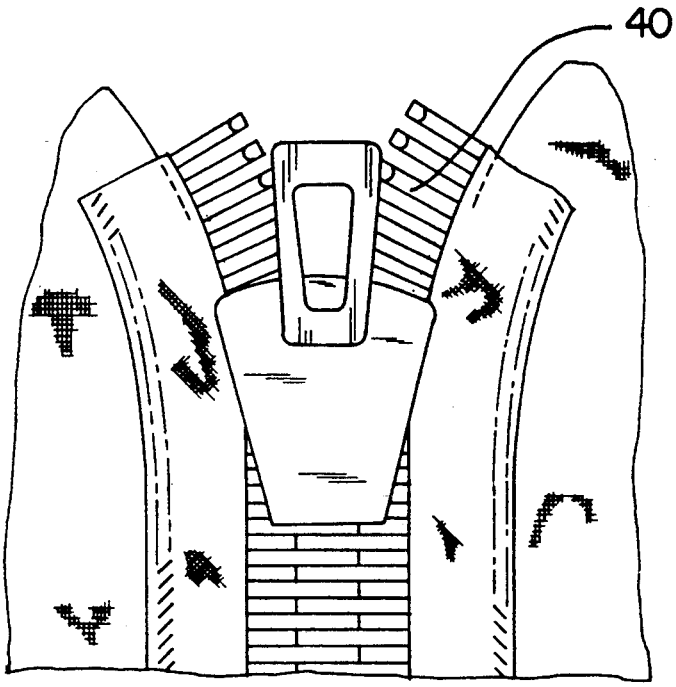
FIG. 7 is an enlarged view of the zipper of the present invention.
Figure 8:
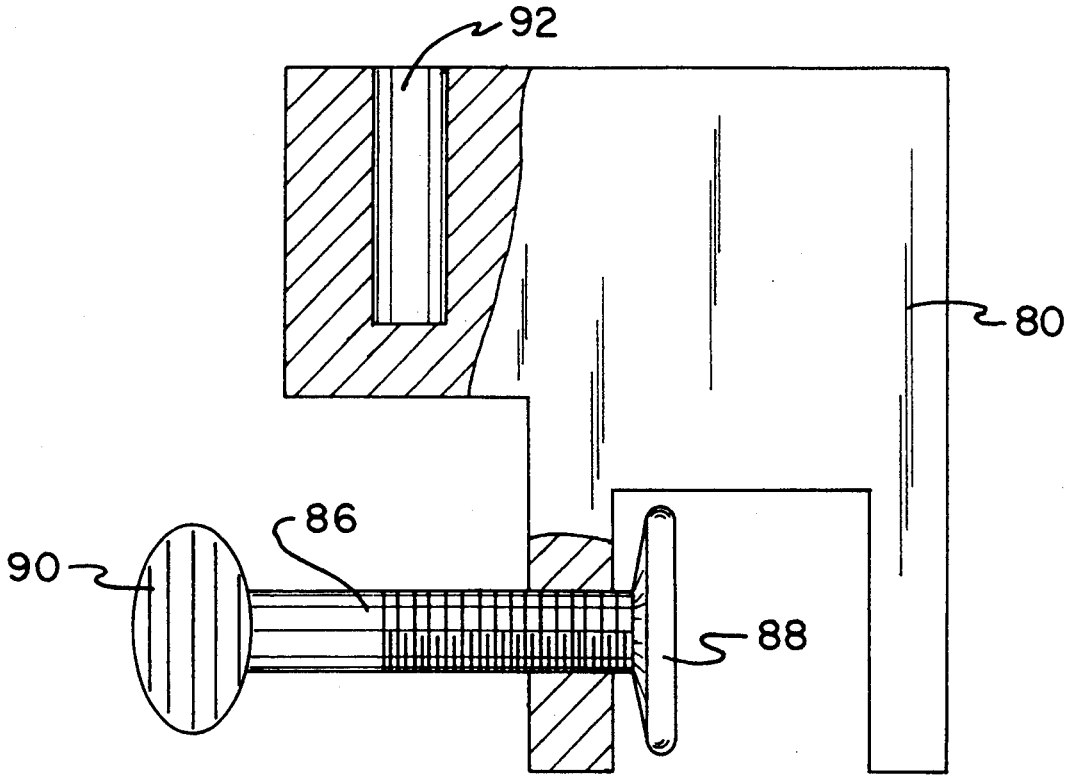
FIG. 8 is a view of one of the clamps of the present invention used for securing the cover to a recipient object for use as a blind.

With reference now to the drawings, and in particular, to FIG. 1 thereof, the preferred embodiment of the new and improved archery bow case and blind combination embodying the principles and concepts of the present invention and generally designated by the reference number 10 will be described.

The present invention is comprised of a plurality of components. In their broadest context, such components include a cover, rods, and clamps. Such components are individually configured and correlated with respect to each other to provide the intended function of holding a bow in one mode of operation and serving as a blind for hunting in another mode of operation.

Specifically, the archery bow case and blind combination includes a cover 12. The cover is formed of a first sheet of camouflage-type material. This sheet may be formed of cloth, canvas, or an elastomeric compound. The cover includes an exterior surface 14 and an interior surface 16. The cover has a elongated shape formed of a generally rectangular rear portion 18 with a generally trapezoidal and integral front portion 20. A periphery encloses the front portion and rear portion. The periphery is formed of a front edge 22, a rear edge 24, and a pair of opposed side edges 26. A midline 28 is defined though the cover. The midline is linearly and perpendicularly extended from the midpoint of the front edge to the midpoint of the rear edge. The cover also includes a lining 30. The lining is formed of a second sheet of soft cloth material. The lining is extended across and secured to the interior surface. The lining precludes a bow disposed within the cover from being damaged or scratched when transported. The sheets are foldable along the midline to conceal the lining from view and create two symmetrically opposed sides. The sides form a hollow interior 32 therebetween. This interior is sized for receiving a bow 34.

A zipper 40 is coupled along the front edges 22 and side edges 26 of the cover. The zipper has a closed orientation for generally securing the sides to each other. The zipper also has an open orientation for releasing the sides from each other to allowing ready access to the interior. Buttons, snaps, or the like may be used in lieu of the zipper.

In order to allow the cover to serve as a blind, fiberglass rods are provided. The present invention utilizes a first rod 50, a second rod 52 and a third rod 53. The rods are formed of a rigid fiberglass material. The first and second rods are arcuate in structure and secured along opposed side edges of the cover on the interior surface. The third rod is linear in structure and secured along the midline of the cover on the interior surface. Each rod has an end projected outwardly from the rear edge of the cover and terminated at a point 54. The points of the rods are securable within a recipient object such as a patch of ground for holding the cover in an upstanding position. When placed in the upstanding position, the cover may now be used as a blind for concealing a hunter.

The present invention also includes a second coupling mechanism secured to the cover. This coupling mechanism is formed of a strip of pile type fastener 60 secured to the exterior surface of the side of the cover near the rear edge thereof. Also provided is a flap 62 secured to the rear edge of the other side of the cover. This flap has a strip of complimentary pile type fastener 64 coupled thereto. The strips are securable to each other in one mode for precluding access to the interior when the zipper is in the closed orientation. The strips are also releasable from each other in another mode for allowing quick access to the interior when the zipper is in the closed orientation. Thus, the coupling mechanism allows quick and ready access to a bow placed therein without having to unzip the zipper.

To allow the cover with bow therein to be carried, a handle 70 is provided. The handle is coupled to the exterior surface of the cover at the midline thereof. The handle allows a user a firm grip.

Figure 9:
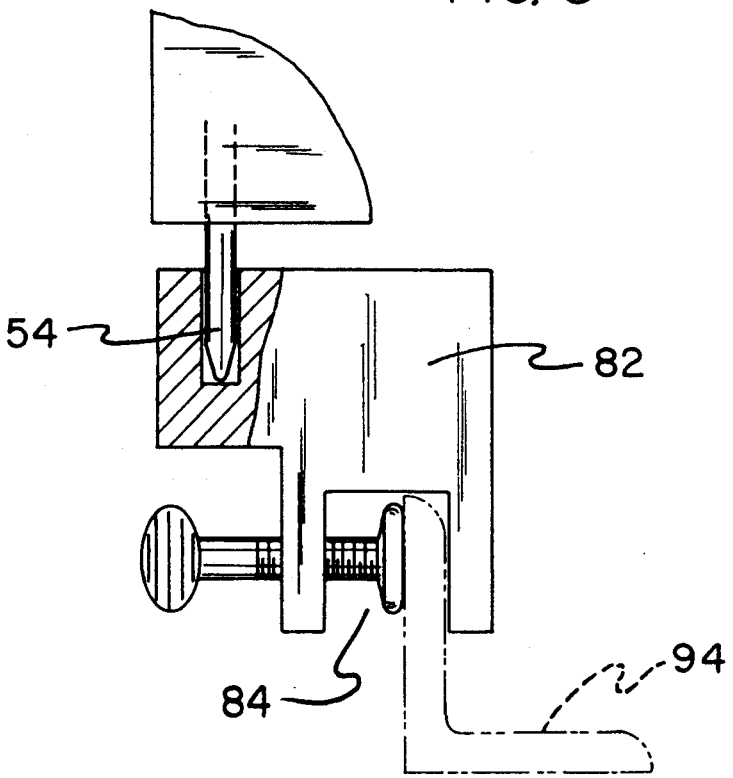
FIG. 9 is a view of the mating between one of the rods and a clamp of the present invention. Also depicted is the securement of the clamp to a recipient object.

The cover may also be secured to a tree stand or the like through the use of clamps. The present invention includes three rigid clamps for performing this function. Each clamp 80 has a body 82 with a mouth 84. An adjustable bolt 86 is threadedly coupled to the body and extendable through the mouth. The bolt is formed with a plunger 88 on one end and a tip 90 for tightening on the other end. Furthermore, a bore 92 is formed on the body at a location opposite the mouth. The bore is used for receiving a point of a rod. The clamps are thus coupleable to a recipient object such as a tree stand 94 for allowing the cover to be placed in an upstanding position for use as a blind when the points of the rods are disposed within the bores as shown in FIG. 9.

The present invention is a combination archery case and blind. The present invention resolves the problem of what to do with an archery case once the contents thereof are removed. The present invention consists of a case made of a camouflage-colored cloth with ¼ inch diameter fiberglass rods sewn along its length in the middle and along its two sides. Each half or side of the case (from the midline to each side edge) measures about 20 inches. The rods extend out about 4 inches from the rear edge of the cover. The other parts of the rods are completely covered. The case has a zipper closure. The rear edge of the cover is straight, but the top gradually tapers narrower, forming a modified "V" when the cover is opened. Aluminum adapters or clamps are included for coupling the cover and rods to a tree stand. Also, the present invention can be made in a version with four panels (i.e., twice as wide) instead of two.

After removing a bow from the present invention, the present invention can be used as a blind by leaving it in an open extended and upstanding position and inserting the rods in a patch of ground in front of a tree seat. The tapered top provides "shooting lanes" for the hunter to scout for game and shoot through. Alternatively, the clamps of the present invention attach the rods and cover directly to a tree stand.

Many states have laws requiring bows to be kept in a case except during hunting hours. The problem for many hunters has been what to do with the case once they begin hunting. The present invention resolves this problem.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An archery bow case and blind combination for allowing an archer to transport a bow from one location to another and conceal himself from potential targets comprising:

a cover formed of a first sheet of camouflage-type cloth material, the cover including an exterior surface, an interior surface, a generally rectangular rear portion, a generally trapezoidal front portion, a periphery enclosing the portions formed of a front edge, a rear edge, and a pair of opposed side edges, and a midline defined therethrough and extended from the midpoint of the front edge to the midpoint of the rear edge, the cover further including a lining formed of a second sheet of cloth material extended across and secured to the interior surface and with the sheets foldable along the midline to conceal the lining and create two symmetrically opposed sides with a hollow interior defined therebetween sized for receiving a bow;

a zipper coupled along the front and side edges of the cover with the zipper having a closed orientation for securing the sides to each other and an open orientation for releasing the sides from each other;

a first, a second, and a third rigid fiberglass rod with the first and second rod secured along opposed side edges of the cover and with the third rod secured along the midline of the cover, each rod having an end projected outwardly from the rear edge of the cover and terminated at a point and with the points of the rods securable within a recipient object for holding the cover in an upstanding position for use as a blind;

a coupling mechanism formed of a strip of pile type fastener secured to the exterior surface of a side of the cover near the rear edge thereof and flap secured to the rear edge of the other side of the cover with a strip of complimentary pile type fastener coupled thereto, the strips securable to each other in one mode and releasable from each other in another mode for allowing quick access to the interior when the zipper is in the closed orientation;

a handle coupled to the exterior surface of the cover at the midline for allowing a user a firm grip; and three rigid clamps, each clamp having a body with a mouth, an adjustable bolt threadedly coupled to the body and extendable within the mouth, and a bore formed on the body opposite the mouth for receiving a point of a rod, the clamps coupleable to a recipient object for allowing the cover to be used as a blind when the points of the rods are disposed within the bores.

2. An archery bow case and blind combination comprising:

a cover formed of a sheet of flexible material, the cover including an exterior surface, an interior surface, a periphery formed of a front edge, a rear edge, and a pair of opposed side edges, and a midline defined therethrough and extended from the front edge to the rear edge, the cover foldable along the midline to create two symmetrically opposed sides with a hollow interior defined therebetween sized for receiving a bow;

coupling means coupled along the periphery of the cover for releasably securing the sides to each other and precluding access to the interior;

a pair of rods secured along opposed side edges of the cover with each rod having an end projected outwardly from the rear edge of the cover for securement within a recipient object for holding the cover in an upstanding position for use as a blind; and handle means coupled to the exterior surface of the cover for allowing a user a firm grip.

3. The archery bow case and blind combination as set forth in claim 2 wherein the cover is formed of a generally rectangular rear portion and a generally trapezoidal front portion.

4. The archery bow case and blind combination as set forth in claim 2 further including a lining extended across and secured to the interior surface of the cover.

5. The archery bow case and blind combination as set forth in claim 2 wherein the coupling means is a zipper.

6. The archery bow case and blind combination as set forth in claim 2 wherein the coupling means comprises:

a zipper coupled along the front and side edges of the cover with the zipper having a closed orientation for securing the sides to each other and an open orientation for releasing the sides from each other; and a strip of pile type fastener secured to the exterior surface of a side of the cover near the rear edge thereof and flap secured to the rear edge of the other side of the cover with a strip of complimentary pile type fastener coupled thereto, the strips securable to each other in one mode and releasable from each other in another mode for allowing quick access to the interior when the zipper is in the closed orientation.

7. The archery bow case and blind combination as set forth in claim 2 including a third rod secured along the midline of the cover and having an end projected outwardly from the rear edge thereof for securement within a recipient object.

8. The archery bow case and blind combination as set forth in claim 2 including a plurality of adjustable clamps with each clamp coupleable to an end of a rod and securable to a recipient object for allowing the cover to be used as a blind.

* * * * *